US007278929B2

(12) United States Patent
Umezawa et al.

(10) Patent No.: US 7,278,929 B2
(45) Date of Patent: Oct. 9, 2007

(54) THREE-PIECE SOLID GOLF BALL

(75) Inventors: Junji Umezawa, Chichibu (JP); Kazufumi Tabata, Chichibu (JP); Hiroyuki Nagasawa, Chichibu (JP); Yoshihiro Yamana, Tokyo (JP); Hidekazu Saito, Kurashiki (JP); Hiroki Kimura, Kurashiki (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 36 days.

(21) Appl. No.: 11/120,961

(22) Filed: May 4, 2005

(65) Prior Publication Data

US 2006/0252579 A1 Nov. 9, 2006

(51) Int. Cl.
*A63B 37/06* (2006.01)

(52) U.S. Cl. ..... 473/373

(58) Field of Classification Search ..... 473/373, 473/374, 376

See application file for complete search history.

(56) References Cited

U.S. PATENT DOCUMENTS

| | | | | |
|---|---|---|---|---|
| 5,553,852 | A | 9/1996 | Higuchi et al. | |
| 5,899,822 | A | 5/1999 | Yamagishi et al. | |
| 6,592,470 | B2 | 7/2003 | Watanabe et al. | |
| 6,659,889 | B2 | 12/2003 | Kasashima et al. | |
| 6,814,676 | B2 | 11/2004 | Watanabe et al. | |
| 2004/0029650 | A1 * | 2/2004 | Higuchi et al. | 473/371 |
| 2005/0014577 | A1 * | 1/2005 | Sasaki et al. | 473/371 |

FOREIGN PATENT DOCUMENTS

| | | | |
|---|---|---|---|
| JP | 7-24085 | A | 1/1995 |
| JP | 10-151226 | A | 6/1998 |
| JP | 2001-054588 | * | 2/2001 |
| JP | 2002-315848 | A | 10/2002 |
| JP | 2003-190330 | A | 7/2003 |

* cited by examiner

*Primary Examiner*—Raeann Trimiew
(74) *Attorney, Agent, or Firm*—Sughrue Mion Pllc.

(57) ABSTRACT

A three-piece solid golf ball composed of a solid core, an intermediate layer which encloses the core, and a cover layer which encloses and is softer than the intermediate layer is characterized in that the solid core undergoes a deflection of 2.8 to 3.6 mm when a load of 130 kg is applied thereto from an initial load of 10 kg and has a surface hardness and a center hardness which differ by at least 15 Shore D hardness units; the intermediate layer has a surface hardness which differs from the surface hardness of the solid core by not more than 12 Shore D hardness units; and the cover layer has a surface hardness which differs from the surface hardness of the intermediate layer by at least 7 Shore D hardness units, is made primarily of a thermoplastic polyurethane, and has a thickness in a range of 0.5 to 1.3 mm. This combination of features provides an overall outstanding golf ball endowed with excellent flight characteristics, excellent controllability and durability, and a soft feel on impact.

15 Claims, 1 Drawing Sheet

THREE-PIECE SOLID GOLF BALL

BACKGROUND OF THE INVENTION

Figure 1:
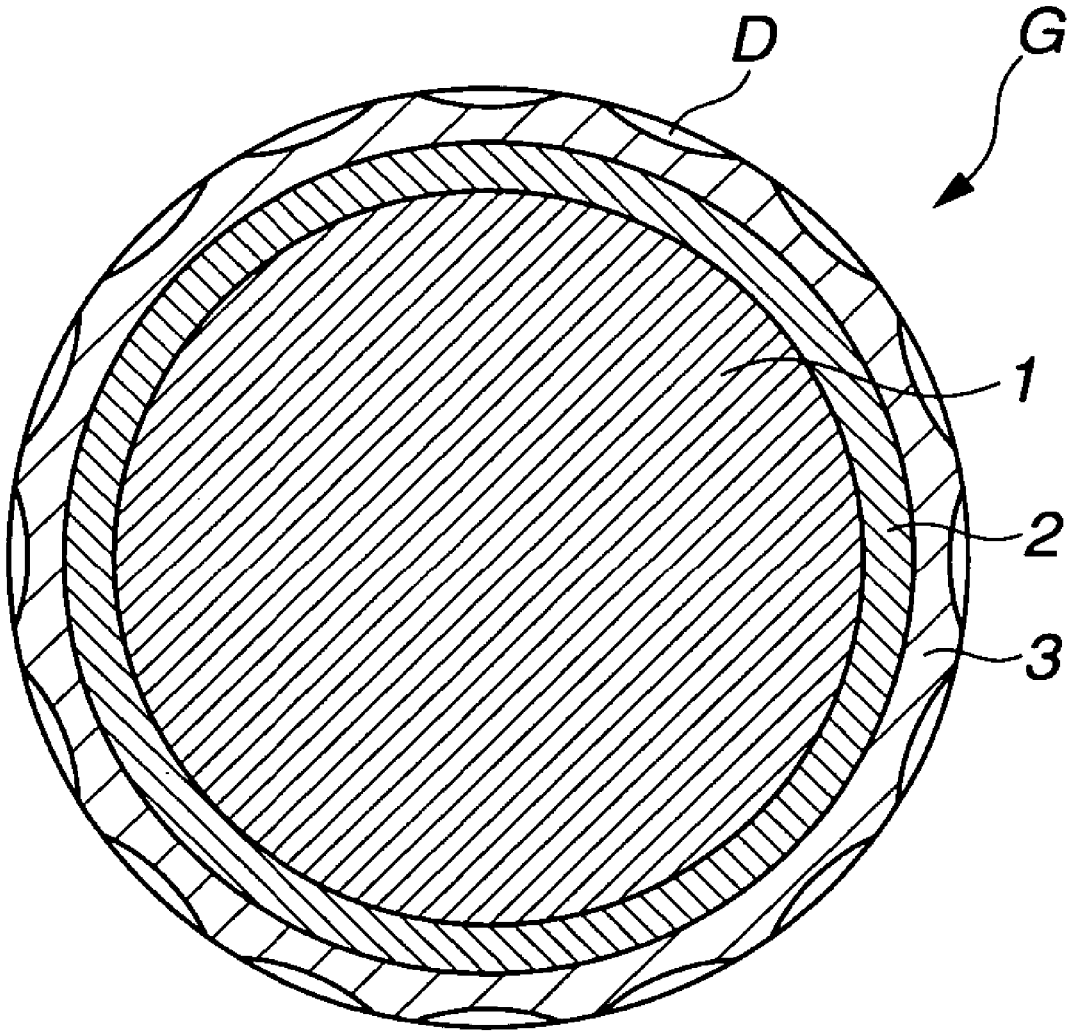

The present invention relates to a three-piece solid golf ball which has an intermediate layer and a cover layer that is softer than the intermediate layer; i.e., a three-piece solid golf ball which is hard on the interior and soft at the exterior.

A solid golf ball having a three-piece construction which is hard on the interior and soft at the exterior has been proposed to address the desires of professional golfers and skilled amateurs (Patent Reference 1: JP-A 7-24085). In addition, JP-A 10-151226 (Patent Reference 2) discloses a golf ball of this type which is endowed with improved spin, flight characteristics and durability. Yet, even such improved golf balls often fall short of what is desired.

Three-piece solid golf balls are also disclosed in, for example, JP-A 2002-315848 (Patent Reference 3), JP-A 2003-190330 (Patent Reference 4) and U.S. Pat. No. 6,659,889. However, still further improvement is desired.

It is therefore an object of the present invention to provide an overall outstanding three-piece solid golf ball which is endowed in particular with excellent flight characteristics, excellent controllability and durability, and a soft feel on impact.

SUMMARY OF THE INVENTION

We have found that, in a three-piece solid golf ball composed of a solid core, an intermediate layer and a cover layer, by optimizing the hardnesses and thicknesses of the intermediate layer and the cover layer, suitably selecting the intermediate layer material, and also optimizing the dimples and the core hardness, this combination of features has synergistic effects which increase the distance of the ball when hit with a driver, provide the ball with good controllability when played with an iron or putter, confer the ball with excellent durability such as crack and scuff resistance, and impart to the golfer a soft feel at the moment of impact. The result is an overall outstanding golf ball.

Accordingly, the invention provides the following three-piece solid golf ball.

(1) A three-piece solid golf ball composed of a solid core, an intermediate layer which encloses the core, and a cover layer which encloses and is softer than the intermediate layer, which golf ball is characterized in that the solid core undergoes a deflection of 2.8 to 3.6 mm when a load of 130 kg is applied thereto from an initial load of 10 kg and has a surface hardness and a center hardness which differ by at least 15 Shore D hardness units; the intermediate layer has a surface hardness which differs from the surface hardness of the solid core by not more than 12 Shore D hardness units; and the cover layer has a surface hardness which differs from the surface hardness of the intermediate layer by at least 7 Shore D hardness units, is made primarily of a thermoplastic polyurethane, and has a thickness in a range of 0.5 to 1.3 mm.

The invention also provides, as preferred embodiments, the following golf balls (2) to (7).

(2) The three-piece solid golf ball of (1) above, wherein the cover layer is made of a thermoplastic polyurethane composition composed primarily of a thermoplastic polyurethane obtained by a polyurethane-forming reaction of an organic diisocyanate compound with a long-chain polyol and a chain extender, and the cover layer has an inherent viscosity in a DMF solvent of at least 1.5 dl/g and an inherent viscosity in a DMF solution containing 0.05 mol/L n-butylamine of at least 0.5 dl/g.

(3) The three-piece solid golf ball of (1) above, wherein the surface hardness of the intermediate layer and the surface hardness of the cover layer differ by not more than 20 Shore D hardness units.

(4) The three-piece solid golf ball of (1) above, wherein the surface hardness and the center hardness of the solid core differ by at least 18 Shore D hardness units.

(5) The three-piece solid golf ball of (1) above, wherein the solid core is made of a rubber composition obtained by blending (a) a polybutadiene, (b) sulfur, (c) an unsaturated carboxylic acid and/or metal salt thereof, (d) an organosulfur compound, (e) an inorganic filler and (f) an organic peroxide.

(6) The three-piece solid golf ball of (1) above, wherein the intermediate layer is made of a material that includes a compound having at least two reactive functional groups and a molecular weight of not more than 20,000 or is treated at the surface thereon with a primer.

(7) The three-piece solid golf ball of (1) above, wherein the cover layer has formed on the surface thereof 250 to 350 dimples of at least five types of mutually differing diameter and/or depth, and the dimples have a surface coverage ratio (SR) of at least 79%.

BRIEF DESCRIPTION OF THE DIAGRAMS

FIG. 1 is cross-sectional diagram of a three-piece golf ball according to the invention.

DETAILED DESCRIPTION OF THE INVENTION

The three-piece solid golf ball G of the invention has the ball construction shown in FIG. 1. Specifically, the ball G has a solid core 1, an intermediate layer 2 which encloses the core 1, and a cover layer 3 which encloses and is softer than the intermediate layer 2. Generally, a large number of dimples D are formed on the outside surface of the cover layer 3.

In the invention, the solid core can be formed using a rubber composition containing, for example, a co-crosslinking agent, an organic peroxide, an inert filler and an organosulfur compound. The base rubber of the rubber composition is preferably one in which polybutadiene serves as the primary component. "Primary component" here signifies that the polybutadiene accounts for a proportion of the base rubber that is at least 50 wt %, preferably at least 70 wt %, and most preferably 100 wt %.

In the practice of the invention, the rubber composition making up the solid core is preferably one obtained by blending (a) a polybutadiene, (b) sulfur, (c) an unsaturated carboxylic acid and/or metal salt thereof, (d) an organosulfur compound, (e) an inorganic filler and (f) an organic peroxide. This rubber composition is described below.

The polybutadiene used as component (a) has a cis-1,4 bond content of at least 60%, preferably at least 80%, more preferably at least 90%, and most preferably at least 95%, and has a 1,2-vinyl bond content of not more than 2%, preferably not more than 1.7%, more preferably not more than 1.5%, and most preferably not more than 1.3%. Outside of this range, the rebound decreases.

The polybutadiene used as component (a) has a viscosity $\eta$ (mPa·s) at 25° C. as a 5 wt % solution in toluene of not more than 600. Here, "viscosity η (mPa·s) at 25° C. as a 5 wt % solution in toluene" refers to the value obtained by dissolving 2.28 g of the polybutadiene to be measured in 50 ml of toluene and using a standard fluid for viscometer calibration (JIS Z8809) as the reference to carry out measurement at 25° C. with a given viscometer.

The polybutadiene used as component (a) has a viscosity η (mPa·s) at 25° C. as a 5 wt % solution in toluene of not more than 600, particularly not more than 550, preferably not more than 500, more preferably not more than 450, and most preferably not more than 400. If the viscosity η is too high, the workability worsens. It is recommended that η be at least 50, preferably at least 100, more preferably at least 150, and even more preferably at least 200. If η is too low, the rebound may decrease.

The polybutadiene used as component (a) has a Mooney viscosity ($ML_{1+4}$ (100° C.)) of at least 30, preferably at least 40, and more preferably at least 50. There is no particular upper limit on the Mooney viscosity, although it is recommended that this value be preferably not more than 80, more preferably not more than 70, even more preferably not more than 65, and most preferably not more than 60.

The term "Mooney viscosity" used herein refers in each instance to an industrial indicator of viscosity (JIS K6300) as measured with a Mooney viscometer, which is a type of rotary plastometer. This value is represented by the symbol $ML_{1+4}$ (100° C.), wherein "M" stands for Mooney viscosity, "L" stands for large rotor (L-type), and "1+4" stands for a pre-heating time of 1 minute and a rotor rotation time of 4 minutes. The "100° C." indicates that measurement was carried out at a temperature of 100° C.

The polybutadiene used as component (a) is synthesized with a rare-earth catalyst. Examples of rare-earth catalysts that may be used for this purpose include known rare-earth catalysts made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in Fine Chemical 23, No. 9, 5 (1994), J. Am. Chem. Soc. 115, 4971 (1993), and J. Am. Chem. Soc. 117, 6465 (1995) are also acceptable.

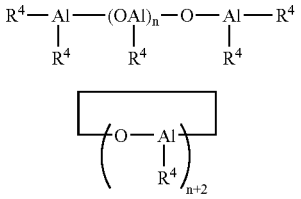

(I)

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base can be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 content and a low 1,2-vinyl content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of generally −30 to +150° C., and preferably 10 to 100° C.

The polybutadiene used as component (a) in the invention may be a modified polybutadiene obtained by polymerization using the above-described rare-earth catalyst, followed by the reaction of a terminal modifier with active end groups on the polymer.

A known terminal modifier may be used for this purpose. Illustrative examples include compounds of types (1) to (7) below.

(1) The modified polybutadiene can be obtained by reacting an alkoxysilyl group-bearing compound with active end groups on the polymer. Preferred alkoxysilyl group-bearing compounds are alkoxysilane compounds having at least one epoxy group or isocyanate group on the molecule. Specific examples include epoxy group-bearing alkoxysilanes such as 3-glycidyloxypropyltrimethoxysilane, 3-glycidyloxypropyltriethoxysilane, (3-glycidyloxypropyl)methyldimethoxysilane, (3-glycidyloxypropyl)methyldiethoxysilane, β-(3,4-epoxycyclohexyl)trimethoxysilane, β-(3,4-epoxycyclohexyl)triethoxysilane, β-(3,4-epoxycyclohexyl)methyldimethoxysilane, β-(3,4-epoxycyclohexyl)ethyldimethoxysilane, condensation products of 3-glycidyloxypropyltrimethoxysilane, and condensation products of (3-glycidyloxypropyl)methyl-dimethoxysilane; and isocyanate group-bearing alkoxysilane compounds such as 3-isocyanatopropyltrimethoxysilane, 3-isocyanatopropyltriethoxysilane, (3-isocyanatopropyl)methyldimethoxysilane, (3-isocyanatopropyl)methyldiethoxysilane, condensation products of 3-isocyanatopropyltrimethoxysilane and condensation products of (3-isocyanatopropyl)methyldimethoxysilane.

A Lewis acid can be added to accelerate the reaction when the above alkoxysilyl group-bearing compound is reacted with active end groups. The Lewis acid acts as a catalyst to promote the coupling reaction, thus improving cold flow by the modified polymer and providing a better shelf stability. Examples of suitable Lewis acids include dialkyltin dialkyl malates, dialkyltin dicarboxylates and aluminum trialkoxides.

Other types of terminal modifiers that may be used include:

(2) halogenated organometallic compounds, halogenated metallic compounds and organometallic compounds of the general formulas $R^5_nM'X_{4-n}$, $M'X_4$, $M'X_3$, $R^5_nM'$ (—$R_6$—

$COOR^7)_{4-n}$ or $R^5{}_nM'$ $(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(3) heterocumulene compounds having on the molecule a Y═C=Z linkage (wherein Y is a carbon, oxygen, nitrogen or sulfur atom; and Z is an oxygen, nitrogen or sulfur atom);

(4) three-membered heterocyclic compounds containing on the molecule the following bonds

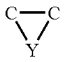

(wherein Y is an oxygen, nitrogen or sulfur atom);

(5) halogenated isocyano compounds;

(6) carboxylic acids, acid halides, ester compounds, carbonate compounds and acid anhydrides of the formula $R^8—(COOH)_m$, $R^9(COX)_m$, $R^{10}—(COO—R^{11})$, $R^{12}—OCOO—R^{13}$, $R^{14}—(COOCO—R^{15})_m$ or

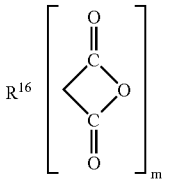

(wherein $R^8$ to $R^{16}$ are each independently a hydrocarbon group of 1 to 50 carbons, X is a halogen atom, and m is an integer from 1 to 5); and (7) carboxylic acid metal salts of the formula $R^{17}{}_lM''(OCOR^{18})_{4-l}$, $R^{19}{}_lM''(OCO—R^{20}—COOR^{21})_{4-l}$ or

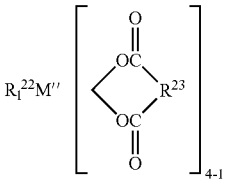

(wherein $R^{17}$ to $R^{23}$ are each independently a hydrocarbon group of 1 to 20 carbons, M" is a tin, silicon or germanium atom, and the letter l is an integer from 0 to 3).

The above terminal modifiers and methods for their reaction are described in, for example, JP-A 11-35633 and JP-A 7-268132.

Component (a) of the invention is compounded within the rubber base in a ratio of at least 20 wt %, preferably at least 25 wt %, more preferably at least 30 wt %, and most preferably at least 35 wt %. The upper limit is 100 wt %, preferably 90 wt % or less, more preferably 80 wt % or less, and most preferably 70 wt % or less. Including too little component (a) will make it difficult to obtain a solid golf ball having a good rebound.

The sulfur used as component (b) is an additive essential for providing the solid core with a large hardness profile, as will be described subsequently. This sulfur may be in the form of a powder, such as the dispersible sulfur produced by Tsurumi Chemical Industry Co., Ltd. under the trade name "Sulfur Z."

The amount of sulfur (b) included per 100 parts by weight of the polybutadiene is from 0.01 to 0.5 part by weight, preferably from 0.01 to 0.4 part by weight, and more preferably from 0.01 to 0.1 part by weight. If too little sulfur is included, it may not be possible to make the hardness profile within the solid core at least a certain minimum size, as a result of which the rebound resilience may decrease, shortening the distance traveled by the ball. On the other hand, too much sulfur may give rise to undesirable effects, such as explosion of the rubber composition during molding under applied heat.

Illustrative examples of unsaturated carboxylic acids that may be included as component (c) include acrylic acid, methacrylic acid, maleic acid and fumaric acid. Acrylic acid and methacrylic acid are especially preferred.

Illustrative examples of unsaturated carboxylic acid metal salts that may be included as component (c) include the zinc and magnesium salts of unsaturated carboxylic acids, such as zinc methacrylate and zinc acrylate. The use of zinc acrylate is especially preferred.

The amount of unsaturated carboxylic acid and/or metal salt included as component (c) per 100 parts by weight of the base rubber is generally at least 10 parts by weight, preferably at least 15 parts by weight, and more preferably at least 20 parts by weight, but generally not more than 60 parts by weight, preferably not more than 50 parts by weight, more preferably not more than 45 parts by weight, and most preferably not more than 40 parts by weight. Too much may make the rubber composition too hard and give the golf ball an unpleasant feel upon impact, whereas too little may lower the rebound.

The organosulfur compound (d) is a component for imparting excellent rebound. The organosulfur compound is not subject to any particular limitation so long as it enhances the resilience of the golf ball. Exemplary organosulfur compounds include thiophenols, thionaphthols, halogenated thiophenols, and metal salts of any of these, as well as polysulfides having 2 to 4 sulfurs. Specific examples of preferred organosulfur compounds include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, diphenylpolysulfides having 2 to 4 sulfurs, dibenzylpolysulfide, dibenzoylpolysulfide, dibenzothiazoylpolysulfide and dithiobenzoylpolysulfide. The zinc salt of pentachlorothiophenol and diphenyldisulfide are especially preferred.

The organosulfur compound (d) is included in an amount, per 100 parts by weight of the base rubber, of generally at least 0.3 part by weight, and preferably at least 0.5 part by weight, but generally not more than 3.0 parts by weight, preferably not more than 2.5 parts by weight, more preferably not more than 2.0 parts by weight, and most preferably not more than 1.5 parts by weight. The use of too much organosulfur compound may make the core too soft, deadening the feel of the ball when played and compromising its durability to cracking with repeated impact. On the other hand, too little organosulfur compound may make the core too hard and may result in a less than satisfactory rebound.

Illustrative examples of the inorganic filler (e) include zinc oxide, barium sulfate and calcium carbonate. The amount of inorganic filler included per 100 parts by weight of the base rubber is at least 5 parts by weight, preferably at least 7 parts by weight, more preferably at least 10 parts by weight, and most preferably at least 13 parts by weight, but not more than 80 parts by weight, preferably not more than 50 parts by weight, more preferably not more than 45 parts by weight, and most preferably not more than 40 parts by weight. Too much or too little inorganic filler may make it impossible to achieve a suitable weight and a desirable rebound.

The organic peroxide (f) may be a commercially available product, illustrative examples of which include Percumil D (produced by NOF Corporation), Perhexa 3M (NOF Corporation), Perhexa C-40 (NOF Corporation), and Luperco 231XL (Atochem Co.). The use of dicumyl peroxide (trade name, Percumil D) or 1,1-bis(tert-butylperoxy)cyclohexane (trade name, Perhexa C-40) is preferred. If necessary, two or more different organic peroxides may be mixed and used together.

The amount of organic peroxide (f) included per 100 parts by weight of the base rubber is at least 0.1 part by weight, preferably at least 1.0 part by weight, and more preferably at least 2.0 part by weight, but not more than 7.0 parts by weight, preferably not more than 6.0 parts by weight, and more preferably not more than 5.0 parts by weight. Too much or too little organic peroxide may make it impossible to achieve a desirable hardness profile; that is, a good feel on impact and good durability and rebound.

If necessary, an antioxidant may be included in the composition. Examples of suitable commercial antioxidants include Nocrac NS-6, Nocrac NS-30 (both available from Ouchi Shinko Chemical Industry Co., Ltd.), and Yoshinox 425 (available from Yoshitomi Pharmaceutical Industries, Ltd.). To achieve a suitable rebound and durability, it is recommended that the amount of antioxidant included per 100 parts by weight of the base rubber be 0 or more part by weight, preferably at least 0.05 part by weight, more preferably at least 0.1 part by weight, and most preferably at least 0.2 part by weight, but generally not more than 3 parts by weight, preferably not more than 2 parts by weight, more preferably not more than 1 part by weight, and most preferably not more than 0.5 part by weight.

The solid core (hot-molded core) can be obtained by vulcanizing and curing the above-described rubber composition by the same type of method as that used with known rubber compositions for golf balls. Vulcanization may be carried out at, for example, a temperature of 100 to 200° C. for a period of 10 to 40 minutes.

It is critical for the hardness difference obtained by subtracting the Shore D hardness at the center of the resulting solid core from the Shore D hardness at the surface of the core to be at least 15, preferably at least 18, more preferably at least 20, and even more preferably at least 22, but preferably not more than 40, more preferably not more than 38, and even more preferably not more than 36. By adjusting the hardness in this way, the spin rate of the ball when a full shot is taken with a driver can be reduced, enabling a longer distance to be achieved.

Here, the surface hardness of the core is the value obtained by measuring the core surface directly with a Shore D durometer, and the center hardness of the core is the value obtained by cutting the core in half and measuring the hardness at the center of the cut halves with a Shore D durometer. Each hardness value is the average of four measurements taken on ten sample cores (the same applies below).

It is recommended that the solid core have a diameter of at least 36.0 mm, preferably at least 36.5 mm, and more preferably at least 37.0, but preferably not more than 40.5 mm, more preferably not more than 39.5 mm, and most preferably not more than 39.0 mm.

The solid core has a deflection, when a load of 130 kg is applied thereto from an initial load of 10 kg, of at least 2.8 mm, preferably at least 3.0 mm, and more preferably at least 3.1 mm, but not more than 3.6 mm, preferably not more than 3.4 mm, and more preferably not more than 3.3 mm. Too small a deflection may worsen the feel of the ball upon impact and, particularly on long shots such as with a driver in which the ball incurs a large deformation, may subject the ball to an excessive rise in spin, reducing the carry. On the other hand, too large a deflection may deaden the feel of the ball when hit and give the ball an insufficient rebound that shortens the distance traveled, and may also worsen the durability of the ball to cracking from repeated impact.

Next, the material used to form the intermediate layer is not subject to any particular limitation, provided it is a material having a hardness which satisfies the conditions of the invention concerning the hardness relationships of this layer with the solid core and the cover layer. The intermediate layer material can generally be selected from among known thermoplastic resins and thermoplastic elastomers. For example, use can be made of an ionomer resin, polyester elastomer or polyamide elastomer, either alone or as a resin mixture with, for example, a urethane resin or an ethylene-vinyl acetate copolymer. An ionomer resin is especially preferred. Suitable examples include Himilan 1605 (produced by DuPont-Mitsui Polychemicals Co., Ltd.) and Surlyn 7930 (produced by E.I. du Pont de Nemours & Co.).

If necessary, the intermediate layer material may also have blended therein various additives, such as pigments, dispersants, antioxidants, ultraviolet absorbers and light stabilizers. Specific examples of additives that may be used for this purpose include inorganic fillers such as zinc oxide, barium sulfate and titanium dioxide.

The thickness of the intermediate layer is not subject to any particular limitation, although it is recommended that the thickness be preferably at least 0.7 mm, but preferably not more than 2.5 mm, and more preferably not more than 2.0 mm.

It is preferable for the intermediate layer to be formed so as to have a surface hardness, expressed as the Shore D hardness, of 62 to 70, preferably 64 to 68, and especially 66 to 68. If the intermediate layer is too soft, the spin rate when various types of shots are taken may increase, shortening the carry of the ball. Moreover, the feel of the ball on impact may become too soft. On the other hand, if the intermediate layer is too hard, the spin rate may decrease, making the ball more difficult to control, in addition to which the feel on impact may become too hard and the resistance of the ball to cracking with repeated impact may worsen. This surface hardness is the value obtained by directly measuring the intermediate layer over an enclosed core with a Shore D durometer. The Shore D hardness is determined in accordance with ASTM-2240.

In the practice of the invention, the difference between the surface hardness of the intermediate layer and the surface hardness of the solid core, expressed in Shore D hardness units, must be no more than 12, and is preferably not more than 10, and more preferably not more than 9. Moreover, the difference between the surface hardness of the intermediate layer and the surface hardness of the solid core, expressed in Shore D hardness units, is preferably at least 4. Outside of this range, the spin rate when the ball is hit with a driver increases, preventing an adequate distance from being achieved, in addition to which the ball may lack sufficient durability to cracking with repeated impact.

Moreover, in the practice of the invention, the cover layer has a surface hardness which is lower (softer) than the surface hardness of the intermediate layer. This difference, represented by the formula (surface hardness of intermediate layer)−(surface hardness of cover layer), when expressed in Shore D hardness units, is at least 7, preferably at least 8, and more preferably at least 9, but preferably not more than 20, more preferably not more than 15, and even more preferably not more than 12. If this difference is too large, the spin may increase excessively, resulting in a poor distance, in addition to which the durability of the ball to repeated impact may worsen. On the other hand, if this difference is too small, the ball has a poor spin controllability on approach shots and the spin stability on fliers suffers.

If necessary, an adhesive may be used at the interface between the intermediate layer and the cover layer to provide the ball with a better durability to impact. Any suitable adhesive may be selected for this purpose, provided the objects of the invention are attainable. Preferred examples of such adhesives include chlorinated polyolefin adhesives (e.g., RB182 Primer, made by Nippon Bee Chemical Co., Ltd.), urethane resin adhesives (e.g., Resamine D6208, made by Dainichi Seika Colour & Chemicals Mfg. Co., Ltd.), epoxy resin adhesives, vinyl resin adhesives, and rubber adhesives. The thickness of the adhesive layer is not subject to any particular limitation, although a thickness of 0.1 to 30 μm is preferred. It is also acceptable to use the adhesive on only part of the intermediate layer surface.

The use of such an adhesive can be omitted by the suitable addition to the intermediate layer of a compound having at least two reactive functional groups and a molecular weight of not more than 20,000. Examples of such compounds having at least two reactive functional groups that may be used include monomers, oligomers and macromonomers which have a total of at least two, and preferably at least three, reactive functional groups of one or more type on each molecule and have a molecular weight of not more than 20,000, and preferably not more than 5,000. The number of reactive functional groups, while not subject to any particular upper limit, is generally five or less, and especially four or less.

"Monomer" is used here in the usual sense of a compound employed as a basic building block in polymer synthesis. "Oligomer" refers to a low-molecular-weight product which is obtained from monomers commonly employed in polymer synthesis and which contains generally at least two monomer units and has a molecular weight of up to several thousand. "Macromonomer" refers to a material which is an oligomer having polymerizable functional groups at the ends and which is employed in the synthesis of graft polymers by copolymerization with various types of functional comonomers. Macromonomers ordinarily have a molecular weight of from several thousand to several tens of thousand. They are generally used as intermediates in the synthesis of plastics and elastomers, and as starting materials for the production of graft polymers. Notable use is being made recently of oligomers and macromonomers having various functional groups.

The reactive functional groups are not subject to any particular limitation, insofar as they are capable of improving adhesion between the components of the golf ball. Preferred examples of reactive functional groups include hydroxyl groups, carbonyl groups, carboxyl groups and amino groups. In the case of a blend with an ionomer resin, hydroxyl groups are especially preferred because they have little effect on the melt flow rate.

Illustrative, non-limiting, examples of suitable monomers include 1,3-butanediol, 1,6-hexanediol and trimethylolpropane. Illustrative, non-limiting examples of suitable oligomers and macromonomers include polyethylene glycol, polyhydroxypolyolefin oligomers, modified low-molecular-weight polyethylene, modified low-molecular-weight polypropylene, modified low-molecular-weight polystyrene, modified liquid polybutadiene and modified liquid rubber. Polyhydroxypolyolefin oligomers and trimethylolpropane are especially preferred. These may be used singly or as combinations of two or more types thereof, as desired.

The above monomer, oligomer or macromonomer may be a commercially available product, such as trimethylolpropane produced by Mitsubishi Gas Chemical Co., Ltd. or the polyhydroxypolyolefin oligomers having 150 to 200 backbone carbons and hydroxyl end groups produced under the trade name Polytail H by Mitsubishi Chemical Corporation.

The cover layer is composed primarily of a thermoplastic polyurethane, thus making it possible to provide a golf ball having an excellent scuff resistance and excellent spin stability on fliers.

It is desirable to use for this purpose a thermoplastic polyurethane which can be obtained by a polyurethane-forming reaction of an organic diisocyanate compound with a long-chain polyol and a chain extender. Illustrative examples include commercially available aliphatic diisocyanates or aromatic diisocyanates such as Pandex (produced by DIC Bayer Polymer, Ltd.) and Kuramiron (produced by Kuraray Co., Ltd.).

It is desirable for the cover layer made of a thermoplastic polyurethane composition containing the above thermoplastic polyurethane to have an inherent viscosity in an N,N-dimethylformamide (DMF) solvent of at least 1.5 dl/g and an inherent viscosity in a DMF solution containing 0.05 mol/L n-butylamine of at least 0.5 dl/g. As used herein, the "inherent viscosity in a DMF solvent" of the thermoplastic polyurethane is computed on the basis of the flow time measured at 30° C. for a DMF solvent of the thermoplastic polyurethane that has been prepared to a concentration of 0.5 g/dl. Likewise, the "inherent viscosity in a DMF solution containing 0.05 mol/L n-butylamine" is computed on the basis of the flow time measured at 30° C. for a 0.05 mol/L n-butylamine-containing DMF solution of the thermoplastic polyurethane that has been prepared to a concentration of 0.5 g/dl. These values are measured by the methods described below in the "Examples" section.

The inherent viscosity of the thermoplastic polyurethane in a DMF solvent is preferably at least 1.7 dl/g, and more preferably at least 1.9 dl/g. It is even more preferable for this inherent viscosity to be at least about 2 dl/g, at which point the thermoplastic polyurethane becomes substantially insoluble in the DMF solvent.

The inherent viscosity of the thermoplastic polyurethane as a 0.05 mol/L n-butylamine-containing DMF solution is preferably at least 0.6 dl/g, more preferably 0.7 to 2.0 dl/g, and even more preferably 0.8 to 1.5 dl/g.

The cover layer in the invention is composed primarily of the above-described thermoplastic polyurethane. Here, "composed primarily of" signifies that the thermoplastic polyurethane represents at least 85 wt % of the resin composition making up the cover layer.

In addition to the above thermoplastic polyurethane, the resin composition of which the cover layer is made may also include other ingredients. Examples of such other ingredients include thermoplastic polymers other than thermoplastic polyurethane, such as polyester elastomers, polyamide elastomers, ionomer resins, styrene block elastomers, polyethylene and nylon resins. The amount in which such thermoplastic polymers other than thermoplastic polyurethane are included, per 100 parts by weight of the thermoplastic polyurethane serving as the essential component therein, is generally 0 to 15 parts by weight, preferably 0 to 10 parts by weight, and more preferably 0 to 5 parts by weight. This amount may be selected as appropriate for such purposes as adjusting the hardness of the cover layer material, improving the rebound, enhancing the flow properties of the material, and improving adhesion.

If necessary, the cover layer may include also various additives other than the ingredients making up the above thermoplastic polyurethane. For example, additives such as pigments, dispersants, antioxidants, light stabilizers, ultraviolet absorbers and parting agents may be suitably included.

It is desirable for the thermoplastic polyurethane to have a structure which includes soft segments made of a polymeric polyol that is a long-chain polyol (polymeric glycol), and hard segments made of a chain extender and an organic diisocyanate. Here, the long-chain polyol used as a starting material is not subject to any particular limitation, and may be any that has been used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly (tetramethylene glycol) and poly(methyltetramethylene glycol) obtained by the ring-opening polymerization of a cyclic ether. The polyether polyol may be used singly or as a combination to two or more thereof. Of these, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made of a thermoplastic polyurethane composition having excellent properties such as rebound and manufacturability can be reliably obtained. The number-average molecular weight of the long-chain polyol is more preferably in a range of 1,700 to 4,000, and even more preferably in a range of 1,900 to 3,000.

In this specification, "number-average molecular weight of the long-chain polyol" refers to the number-average molecular weight computed based on the hydroxyl number measured in accordance with JIS K-1557.

Chain extenders suitable for use include those used in the prior art relating to thermoplastic polyurethanes. For example, low-molecular-weight compounds which have a molecular weight of not more than 400 and bear on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these chain extenders, aliphatic diols having 2 to 12 carbons are preferred, and 1,4-butylene glycol is especially preferred.

Suitable organic diisocyanates include those used in the prior art relating to thermoplastic polyurethanes. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. Depending on the type of isocyanate used, the crosslinking reaction during injection molding may be difficult to control. In the practice of the invention, to provide a balance between stability at the time of production and the properties that emerge, it is most preferable to use 4,4'-diphenylmethane diisocyanate, which is an aromatic diisocyanate.

It is most preferable for the thermoplastic polyurethane used in the invention to be one synthesized using a polyether polyol as the long-chain polyol, an aliphatic diol as the chain extender, and an aromatic diisocyanate as the organic diisocyanate compound, and specifically one synthesized using poly(tetramethylene glycol) having a number-average molecular weight of 1,900 as the polyether polyol, 1,4-butylene glycol as the chain extender, and 4,4'-diphenylmethane diisocyanate as the aromatic diisocyanate.

The above thermoplastic polyurethane is prepared by a polyurethane-forming reaction between the long-chain polyol, the organic diisocyanate compound and the chain extender. In the thermoplastic polyurethane, it is desirable to set the content of nitrogen atoms originating from the organic diisocyanate compound, as a percentage of the weight of the long-chain polyol, organic diisocyanate compound and chain extender combined, within a range of 4.0 to 6.5 wt %. In this way, golf balls made of a thermoplastic polyurethane composition having excellent properties such as rebound, spin characteristics, scuff resistance and manufacturability can be reliably obtained.

The ratio of active hydrogen atoms to isocyanate groups in the polyurethane-forming reaction can be set within a desirable range so as to enable golf balls endowed with excellent properties such as rebound, spin performance, scuff resistance and manufacturability to be obtained.

No particular limitation is imposed on the method of preparing the thermoplastic polyurethane. Production may be carried out by either a prepolymer process or a one-shot process in which the long-chain polyol, chain extender and organic diisocyanate are used and a known urethane-forming reaction is carried out. Of these, a process in which melt polymerization is carried out in a substantially solvent-free state is preferred. Production by continuous melt polymerization using a multi-screw extruder is especially preferred.

The cover layer can be formed by, for example, molding the cover layer material with an injection molding machine around a core-enclosing intermediate layer. The molding temperature varies with the type of thermoplastic polyurethane, but is generally in a range of 150 to 250° C.

If injection molding is carried out, it is desirable, though not essential, to carry out a nitrogen purge or vacuum treatment at some or all places on the resin paths from the resin feed area to the mold interior, and to carry out molding in a low-humidity environment.

After the cover layer has been formed as described above, the properties of this layer as a golf ball cover layer can be further improved by carrying out annealing so as to induce the crosslinking reaction to proceed even further. "Annealing," as used herein, refers to aging the cover layer in a fixed environment for a fixed length of time.

The above crosslinking reaction is believed to involve the reaction of residual isocyanate groups with residual hydroxyl groups in the thermoplastic polyurethane composition to form new urethane bonds, and addition reactions by residual isocyanate groups onto the urethane groups of the thermoplastic polyurethane to form allophanate or biuret crosslinks.

The annealing temperature can be set to generally at least 40° C., preferably at least 45° C., more preferably at least 50° C., and even more preferably at least 70° C. If the temperature during annealing is too low, this step may do little to induce the crosslinking reaction to proceed. On the other hand, in cases where the cover layer is itself composed of two or more constituent layers and a portion thereof is formed of an ionomer resin, or in cases where the inventive golf ball is composed of a core, an intermediate layer enclosing the core, and a cover layer enclosing the intermediate layer, which intermediate layer is made of an ionomer resin, if annealing is carried out at too high a temperature, the temperature may exceed the cluster melting point Ti of the ionomer resin, as a result of which the rebound of the golf ball may decrease. Also, exceeding the melting point Tm of the ionomer resin may result in deformation of the intermediate layer.

No particular limitation is imposed on the means for carrying out such annealing. Annealing may be carried out in an oven, or by installing within the manufacturing process a heat source place and having the workpieces pass over that place. The annealing time, which may be set as appropriate for the annealing treatment temperature within a range that elicits the desired treatment effects, is generally at least 30 minutes, preferably at least 1 hour, and most preferably at least 2 hours.

The cover layer has a surface hardness, expressed as the Shore D hardness, of generally 52 to 60, preferably 54 to 58, and more preferably 55 to 57. If the surface hardness of the cover layer is too low, the spin rate when the ball is played with a driver may increase, shortening the carry of the ball. On the other hand, if the surface hardness of the cover layer is too high, the spin rate may decrease, making the ball difficult to control, in addition to which the durability to cracking with repeated impact and the scuff resistance may decrease, and the feel of the ball during the short game and when hit with a putter may worsen.

"Shore D hardness" refers here to the hardness measured with a type D durometer in accordance with ASTM D-2240.

It is recommended that the cover layer have a thickness of generally at least 0.5 mm, and preferably at least 0.6 mm, but not more than 1.3 mm, and preferably not more than 1.1 mm. If the cover layer is too thick, the ball may take on too much spin on long shots such as with a driver in which the ball incurs a large deformation. On the other hand, if the cover layer is too thin, the ball may have a poor feel in the short game, a poor spin stability on fliers, and a poor durability, especially a poor scuff resistance.

The combined thickness of the cover layer and the intermediate layer, while not subject to any particular limitation, is preferably from 1.5 to 4.0 mm, and more preferably from 1.8 to 3.0 mm.

A large number of dimples can be formed on the surface (cover layer surface) of the inventive golf ball. The number of dimples formed on the surface of the ball is preferably from 250 to 350, and more preferably from 280 to 340. In the invention, a number of dimples within this range makes the ball more subject to lift forces, and can extend the carry of the ball, particularly when hit with a driver. Preferably, the dimples are formed in a shape that is circular as seen from above, have a diameter of 2 to 6 mm, and especially 2.5 to 5.0 mm, and a thickness of 0.05 to 0.30 mm. To achieve an appropriate trajectory, it is desirable to set the average dimple depth in a range of 0.125 to 0.150 mm.

"Average depth," as used herein, refers to the mean value for the depths of all the dimples. The diameter of a dimple is measured as the distance across the dimple between positions where the dimple region meets land (non-dimple) regions, that is, between the highest points of the dimple region. The golf ball is usually painted, in which case the dimple diameter refers to the diameter after the surface of the ball has been covered with paint. The depth of a dimple is measured by connecting together the positions where the dimple meets the surrounding land so as to define an imaginary plane, and determining the vertical distance from a center position on the plane to the bottom (deepest position) of the dimple.

It is especially preferable for the dimples to be formed in from five to twenty types of mutually differing diameter and/or depth. By combining a plurality of dimple types in this way, the surface coverage ratio can be maximized. Moreover, by setting the surface coverage ratio (SR) of the dimples to preferably at least 79%, more preferably at least 80%, and even more preferably at least 81%, an appropriate trajectory is achieved, enabling the carry to be increased. "Surface coverage ratio (SR)," as used herein, refers to the ratio of the surface area of dimple regions on the ball to the surface area of an imaginary sphere defined by the surface of the ball were it to be free of dimples. This surface coverage ratio is a value obtained from measurements of dimples on a fully manufactured golf ball. For example, when the surface of the ball is subjected to finishing treatment (e.g., painting, stamping) after the cover layer has been formed, SR is calculated based on the shape of the dimples on the manufactured ball after all such treatment has been completed.

If necessary, the surface of the three-piece solid golf ball of the invention can be marked, painted and surface treated.

The three-piece solid golf ball of the invention can be manufactured in accordance with the Rules of Golf for use in competitive play, in which case the ball may be formed to a diameter of, for example, generally 42.64 to 42.80, and to a weight of generally 45.0 to 45.93 g.

As explained above, the solid golf balls of the invention, by having an intermediate layer and a cover of suitably selected hardnesses and thicknesses, an intermediate layer made of a suitably selected material, optimized dimples and an optimized core hardness, are overall outstanding golf balls to which optimal spin characteristics can be imparted on shots taken with an iron and on approach shots—a property much desired by professional and skilled amateur golfers, and which also are able to achieve a good distance and ensure good durability.

EXAMPLES

The following Examples of the invention and Comparative Examples are provided by way of illustration and not by way of limitation.

Examples 1 to 9, and Comparative Examples 1 to 8

Golf ball cores were produced according to an ordinary method by preparing core compositions of the formulations A to J shown in Table 1, then molding and vulcanizing the compositions at 160° C. for 13 minutes. Intermediate layers and cover layers of the respective formulations shown as Nos. 1 to 11 in Table 2 were successively formed by injection molding, first by molding the intermediate layer over the solid core to form a sphere consisting of the core enclosed by the intermediate layer, then by molding the cover layer over the resulting sphere. Using a combination of the five types of dimples shown in Table 3, a total of 330 dimples were formed on the surface of the cover layer. Next, specific markings such as a brand name were administered to the surface of the ball, and a two-part curable urethane coating (clear coating) was applied thereon. The ball was then annealed at 50° C. for 30 minutes, giving a finished three-piece golf ball.

The golf balls obtained in each of Examples 1 to 9 according to the invention and in Comparative Examples 1 to 8 were subjected to evaluations of their flight characteristics, spin on approach shots, feel and durability. The results are shown in Table 4 and 5.

The methods used to measure the core deflection, the core hardness difference, and the surface hardnesses of the intermediate layer and cover layer are described below. All measurements were carried out in a 23° C. environment.

Core Deflection

The amount of deflection (mm) by the core when subjected to an increase in load from an initial load of 10 kg (98 N) to a final load of 130 kg (1,274 N).

Core Surface Hardness and Center Hardness

Both hardnesses were measured as the Shore D hardness (using a type D durometer in accordance with ASTM-2240).

The surface hardness is the average of the values measured at two randomly selected points on the surface of the core.

The center hardness is obtained by cutting the core in half, measuring the hardness at the center of the cut surface on each of the two hemispheres, and taking the average of the two hardness measurements.

Surface Hardness of Intermediate Layer

The value obtained by using a Shore D durometer to measure the hardness at the surface of a sphere consisting of the core enclosed by the intermediate layer.

Surface Hardness of Cover Layer

The value obtained by using a Shore D durometer to measure the hardness (in a dimple-free region) at the surface of a sphere obtained by enclosing the intermediate layer within the cover layer.

The method and criteria for evaluating the performance of the resulting three-piece golf ball are given below.

Flight

The distance traveled by a ball hit with a driver (W#1) at a head speed (HS) of 50 m/s was measured.

Good: 255 m or more

NG: less than 255 m

Spin on Approach

The spin rate of a ball hit with a sand wedge (SW) at a head speed (HS) of 16 m/s was measured.

Good: 6,000 rpm or more

NG: less than 6,000 rpm

Feel

Sensory evaluations were carried out by three top amateur golfers.

Good: good feel

NG: too hard or too soft

Durability with Repeated Impact Until Initial Velocity Decreases

The ball in each example was repeatedly hit with a W#1 at a head speed (HS) of 50 m/s, and the number of times it was hit before the rebound underwent consecutive 3% decreases was rated with respect to an arbitrary durability rating of 100 for the ball obtained in Example 1.

Good: 100 or more

NG: less than 95

Scuff Resistance

The ball was hit with a pitching wedge (PW) at a head speed (HS) of 35 m/s, and the scuff resistance was rated according to the following criteria.

Good: Could be used again

NG: No longer fit for use

TABLE 1

| | (parts by weight) | | | | | | | | | |
|---|---|---|---|---|---|---|---|---|---|---|
| | A | B | C | D | E | F | G | H | I | J |
| Polybutadiene rubber | 95 | 95 | 95 | 95 | 95 | 95 | 100 | 95 | 95 | 95 |
| Polyisoprene rubber | 5 | 5 | 5 | 5 | 5 | 5 | 0 | 5 | 5 | 5 |
| Sulfur | 0.1 | 0.1 | 0.1 | 0.1 | 0.1 | 0.1 | 0 | 0.1 | 0.1 | 0.1 |
| Zinc acrylate | 39.5 | 37.5 | 36 | 38 | 39 | 37.5 | 29.5 | 40.5 | 34.5 | 37.5 |
| Peroxide (1) | 3 | 3 | 3 | 2 | 3 | 3 | 0.3 | 3 | 3 | 3 |
| Peroxide (2) | 0 | 0 | 0 | 0 | 0 | 0 | 0.3 | 0 | 0 | 0 |
| Zinc oxide | 19.67 | 20.46 | 21.05 | 20.57 | 23.16 | 23.74 | 25.51 | 19.28 | 21.65 | 27.41 |
| Zinc pentachlorothiophenol | 1.5 | 1.5 | 1.5 | 1.5 | 1.5 | 1.5 | 0.1 | 1.5 | 1.5 | 1.5 |
| Zinc stearate | 5 | 5 | 5 | 5 | 5 | 5 | 5 | 5 | 5 | 5 |

1) Polybutadiene rubber: JSR BR730

2) Polyisoprene rubber: JSR IR2200

3) Peroxide (1): Dicumyl peroxide (produced by NOF Corporation under the trade name Percumil D)

4) Peroxide (2): 1,1-Bis(t-butylperoxy)cyclohexane (produced by NOF Corporation under the trade name Perhexa 3M-40)

TABLE 2

| | (parts by weight) | | | | | | | | | | |
|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 |
| Himilan 1605 | | 100 | | | | | | | | | |
| Himilan 1557 | | | | 20 | 20 | | | | | | |
| Himilan 1855 | | | | 30 | 30 | | | | | | |
| Surlyn 7930 | 100 | | | | | | | | | | |
| Surlyn 8120 | | | | 50 | 50 | | | | | | |
| AM7317 | | | 50 | | | | | | | | |
| AM7318 | | | 50 | | | | | | | | |
| Trimethylolpropane | 1 | 1 | 1 | 1 | | | | | | | |
| Pandex T8260 | | | | | | 50 | 100 | | | | |
| Pandex T8295 | | | | | | 50 | | 100 | 75 | 50 | |
| Pandex T8290 | | | | | | | | | 25 | 50 | |
| Polyurethane elastomer (Kuraray) | | | | | | | | | | | 100 |
| Titanium dioxide | | | | | 1.5 | 4 | 4 | 4 | 4 | 4 | 4 |
| Polyethylene wax | | | | | | 1.5 | 1.5 | 1.5 | 1.5 | 1.5 | 1.5 |
| Isocyanate compound | | | | | | 10 | 10 | 10 | 10 | 10 | |

Himilan: An ionomer resin produced by Du Pont-Mitsui Polychemicals Co., Ltd.
Surlyn: An ionomer resin produced by E. I. Du Pont de Nemours & Co.
AM7317: A zinc ionomer having an acid content of 18%, produced by Du Pont-Mitsui Polychemicals Co., Ltd.
AM7318: A sodium ionomer having an acid content of 18%, produced by Du Pont-Mitsui Polychemicals Co., Ltd.
Pandex: A thermoplastic polyurethane elastomer produced by DIC Bayer Polymer, Ltd.
Polyurethane elastomer (Kuraray): Kuramiron 5D54-W21-XWF1 (produced by Kuraray Co., Ltd.), a 4,4'-diphenylmethane diisocyanate/1,4-butylene glycol/poly(tetramethylene glycol) type thermoplastic polyurethane having the following properties: melt viscosity, 75 Pa · s; durometer D hardness, 54; rebound resilience, 51%; inherent viscosity in DMF solvent of elastomer before molding, 0.5 dl/g; inherent viscosity in 0.05 mol/L n-butylamine-containing DMF solution of elastomer before molding, 0.5 dl/g; inherent viscosity in DMF solvent of elastomer after molding, ≧2.0 dl/g; inherent viscosity in 0.05 mol/L n-butylamine-containing DMF solution of elastomer after molding, 0.9 dl/g
Isocyanate compound: Crossnate EM30, an isocyanate master batch which is produced by Dainichi Seika Colour & Chemicals Mfg. Co., Ltd., contains 30% of 4,4'-diphenylmethane diisocyanate (measured concentration of amine reverse-titrated isocyanate according to JIS-K1556, 5 to 10%), and in which the master batch base resin is a polyester elastomer. The isocyanate compound was mixed at the time of injection.

TABLE 3

| Dimple type | Number of dimples | Diameter (mm) | Depth (mm) |
|---|---|---|---|
| No. 1 | 12 | 4.6 | 0.145 |
| No. 2 | 234 | 4.4 | 0.140 |
| No. 3 | 60 | 3.8 | 0.140 |
| No. 4 | 6 | 3.5 | 0.150 |
| No. 5 | 6 | 3.4 | 0.130 |
| No. 6 | 12 | 2.6 | 0.100 |

TABLE 4

| | | Example | | | | | | | | |
|---|---|---|---|---|---|---|---|---|---|---|
| | | 1 | 2 | 3 | 4 | 5 | 6 | 7 | 8 | 9 |
| Core | Diameter (mm) | 37.3 | 37.3 | 37.3 | 37.3 | 37.3 | 37.3 | 38.3 | 38.3 | 37.3 |
| | Formulation | A | B | B | B | C | D | E | F | B |
| | Deflection, 10 kg-130 kg (mm) | 2.8 | 3.2 | 3.2 | 3.2 | 3.6 | 3.2 | 2.9 | 3.2 | 3.2 |
| | Core hardness, center (Shore D) | 37.9 | 37.1 | 37.1 | 37.1 | 37.1 | 37.9 | 37.9 | 37.9 | 37.1 |
| | Core hardness, surface (Shore D) | 61.5 | 59.2 | 59.2 | 59.2 | 58.4 | 54.0 | 61.5 | 61.5 | 59.2 |
| | Core hardness difference (surface - center) | 23.6 | 22.0 | 22.0 | 22.0 | 21.2 | 16.0 | 23.6 | 22.0 | 22.0 |
| Intermediate layer | Formulation | No. 1 | No. 1 | No. 1 | No. 1 | No. 1 | No. 2 | No. 1 | No. 1 | No. 1 |
| | Surface hardness (Shore D) | 68 | 68 | 68 | 68 | 68 | 65.5 | 68 | 68 | 68 |
| | Diameter (mm) | 40.6 | 40.6 | 40.6 | 40.6 | 40.6 | 40.6 | 41.6 | 41.6 | 40.1 |
| | Thickness (mm) | 1.65 | 1.65 | 1.65 | 1.65 | 1.65 | 1.65 | 1.65 | 1.65 | 1.40 |

TABLE 4-continued

| | | | Example | | | | | | | | |
|---|---|---|---|---|---|---|---|---|---|---|---|
| | | | 1 | 2 | 3 | 4 | 5 | 6 | 7 | 8 | 9 |
| Cover layer | Formulation | | No. 11 | No. 11 | No. 6 | No. 8 | No. 11 | No. 6 | No. 8 | No. 10 | No. 7 |
| | Thickness (mm) | | 1.03 | 1.03 | 1.03 | 1.03 | 1.03 | 1.03 | 0.52 | 0.52 | 1.28 |
| | Surface hardness (Shore D) | | 57 | 57 | 58 | 55 | 57 | 57 | 55 | 50 | 60 |
| Cover layer quality | Inherent viscosity (before molding) | DMF solvent | 0.5 | 0.5 | 0.6 | 0.6 | 0.5 | 0.6 | 0.6 | 0.6 | 0.6 |
| | | DMF/amine solution | 0.5 | 0.5 | 0.6 | 0.6 | 0.5 | 0.6 | 0.6 | 0.6 | 0.6 |
| | Inherent viscosity (after molding) | DMF solvent | ≧2.0 | ≧2.0 | ≧2.0 | ≧2.0 | ≧2.0 | ≧2.0 | ≧2.0 | ≧2.0 | ≧2.0 |
| | | DMF/amine solution | 0.9 | 0.9 | 0.8 | 0.8 | 0.9 | 0.8 | 0.8 | 0.8 | 0.8 |
| Ball | Diameter (mm) | | 42.7 | 42.7 | 42.7 | 42.7 | 42.7 | 42.7 | 42.7 | 42.7 | 42.7 |
| | Weight (g) | | 45.6 | 45.6 | 45.6 | 45.6 | 45.6 | 45.6 | 45.6 | 45.6 | 45.6 |
| Dimples | Number of dimples | | 330 | 330 | 330 | 330 | 330 | 330 | 330 | 330 | 330 |
| | Dimples types | | 6 types | 6 types | 6 types | 6 types | 6 types | 6 types | 6 types | 6 types | 6 types |
| | SR (%) | | 81 | 81 | 81 | 81 | 81 | 81 | 81 | 81 | 81 |
| Surface hardness | Intermediate layer - core (Shore D) | | 6.5 | 8.8 | 8.8 | 8.8 | 9.6 | 11.5 | 6.5 | 6.5 | 8.8 |
| | Intermediate layer - ball (Shore D) | | 11.0 | 11.0 | 10.0 | 13.0 | 11.0 | 8.5 | 13.0 | 18.0 | 8.0 |
| Flight | Carry (m) | | 238.0 | 237.1 | 237.0 | 236.4 | 236.2 | 237.0 | 237.2 | 235.7 | 237.1 |
| W#1 | Total distance (m) | | 256.5 | 256.1 | 256.4 | 255.6 | 255.2 | 255.7 | 256.2 | 255.1 | 256.2 |
| HS = 50 | Spin (rpm) | | 2600 | 2550 | 2500 | 2610 | 2490 | 2570 | 2570 | 2640 | 2480 |
| | Evaluation | | good | good | good | good | good | good | good | good | good |
| Spin on approach shot | Spin [sand wedge, head speed of 16 m/s] (rpm) | | 6300 | 6260 | 6170 | 6330 | 6210 | 6270 | 6240 | 6390 | 6030 |
| | Evaluation | | good | good | good | good | good | good | good | good | good |
| Feel | W#1 (evaluation) | | good | good | good | good | good | good | good | good | good |
| | Putter (evaluation) | | good | good | good | good | good | good | good | good | good |
| Durability | Durability with repeated impact until rebound decreases | | good | good | good | good | good | good | good | good | good |
| | Scuff resistance | | good | good | good | good | good | good | good | good | good |

TABLE 5

| | | | Comparative Example | | | | | | | |
|---|---|---|---|---|---|---|---|---|---|---|
| | | | 1 | 2 | 3 | 4 | 5 | 6 | 7 | 8 |
| Core | Diameter (mm) | | 37.3 | 37.3 | 37.3 | 37.3 | 37.3 | 37.3 | 37.3 | 36.4 |
| | Formulation | | G | H | I | C | D | D | J | B |
| | Deflection, 10 kg-130 kg (mm) | | 3.2 | 2.6 | 3.8 | 3.6 | 3.5 | 3.5 | 3.2 | 3.2 |
| | Core hardness, center (Shore D) | | 40.7 | 38.7 | 36.4 | 37.1 | 37.9 | 37.9 | 37 | 37 |
| | Core hardness, surface (Shore D) | | 53.7 | 62.3 | 56.0 | 58.4 | 53.7 | 53.7 | 59 | 59 |
| | Core hardness difference (surface - center) | | 12.0 | 23.6 | 19.7 | 21.2 | 15.7 | 15.7 | 22.0 | 22.0 |
| Inter-mediate layer | Formulation | | No. 2 | No. 1 | No. 2 | No. 3 | No. 4 | No. 3 | No. 1 | No. 1 |
| | Surface hardness (Shore D) | | 65.5 | 68 | 65.5 | 71 | 58 | 71 | 68 | 68 |
| | Diameter (mm) | | 40.6 | 40.6 | 40.6 | 40.6 | 40.6 | 40.6 | 40.1 | 39.7 |
| | Thickness (mm) | | 1.65 | 1.65 | 1.65 | 1.65 | 1.65 | 1.65 | 1.40 | 1.65 |
| Cover layer | Formulation | | No. 11 | No. 11 | No. 11 | No. 11 | No. 9 | No. 10 | No. 5 | No. 8 |
| | Thickness (mm) | | 1.03 | 1.03 | 1.03 | 1.03 | 1.03 | 1.03 | 1.28 | 1.48 |
| | Surface hardness (Shore D) | | 57 | 57 | 57 | 57 | 52 | 50 | 58 | 56 |
| Cover layer quality | Inherent viscosity (before molding) | DMF solvent | 0.5 | 0.5 | 0.5 | 0.5 | 0.6 | 0.6 | — | 0.6 |
| | | DMF/amine solution | 0.5 | 0.5 | 0.5 | 0.5 | 0.6 | 0.6 | — | 0.6 |
| | Inherent viscosity (after molding) | DMF solvent | ≧2.0 | ≧2.0 | ≧2.0 | ≧2.0 | ≧2.0 | ≧2.0 | — | ≧2.0 |
| | | DMF/amine solution | 0.9 | 0.9 | 0.9 | 0.9 | 0.8 | 0.8 | — | 0.8 |
| Ball | Diameter (mm) | | 42.7 | 42.7 | 42.7 | 42.7 | 42.7 | 42.7 | 42.7 | 42.7 |
| | Weight (g) | | 45.6 | 45.6 | 45.6 | 45.6 | 45.6 | 45.6 | 45.6 | 45.6 |

TABLE 5-continued

| | | Comparative Example | | | | | | | |
|---|---|---|---|---|---|---|---|---|---|
| | | 1 | 2 | 3 | 4 | 5 | 6 | 7 | 8 |
| Dimples | Number of dimples | 330 | 330 | 330 | 330 | 330 | 330 | 330 | 330 |
| | Dimples types | 6 types | 6 types | 6 types | 6 types | 6 types | 6 types | 6 types | 6 types |
| | SR (%) | 81 | 81 | 81 | 81 | 81 | 81 | 81 | 81 |
| Surface hardness | Intermediate layer - core (Shore D) | 11.8 | 5.7 | 9.5 | 12.6 | 4.3 | 17.3 | 8.8 | 8.8 |
| | Intermediate layer - ball (Shore D) | 8.5 | 11.0 | 8.5 | 14.0 | 6.0 | 21.0 | 10.0 | 12.0 |
| Flight | Carry (m) | 236.6 | 236.6 | 235.2 | 236.8 | 235.2 | 235.0 | 237.1 | 235.4 |
| W#1 | Total distance (m) | 254.7 | 254.5 | 254.2 | 255.8 | 253.9 | 253.8 | 256.5 | 253.9 |
| HS = 50 | Spin (rpm) | 2660 | 2740 | 2440 | 2450 | 2730 | 2710 | 2500 | 2710 |
| | Evaluation | NG | NG | NG | good | NG | NG | good | NG |
| Spin on approach shot | Spin [sand wedge, head speed of 16 m/s] (rpm) | 6320 | 6350 | 6160 | 6140 | 6290 | 6490 | 6070 | 6410 |
| | Evaluation | good | good | good | good | good | good | good | good |
| Feel | W#1 (evaluation) | good | NG | good | good | good | good | good | good |
| | Putter (evaluation) | good | NG | good | good | good | good | good | good |
| Durability | Durability with repeated impact until rebound decreases | good | good | good | NG | good | NG | good | good |
| | Scuff resistance | good | good | good | good | good | good | NG | good |

In Tables 4 and 5 of the examples, the inherent viscosity values for the test substance before and after molding of the cover layer were determined by the following methods.

Inherent Viscosity in DMF Solvent of Test Substance

The test substance is dissolved in DMF to a concentration of 0.5 g/dl, the flow time at 30° C. of the test substance-containing solution is measured using an Ubbelohde viscometer, and the inherent viscosity ($\eta_{inh}$) is determined from the following formula.

$$\text{Inherent viscosity } (\eta_{inh}) \text{ of test substance} = [\ln(t/t_0)]/c$$

In the formula, the letter t represents the flow time (in seconds) for the DMF solvent of the test substance, $t_0$ is the flow time (s) of the solvent (DMF), and c is the concentration (g/dl) of the test substance in the DMF solvent.

Here, if the thermoplastic polyurethane serving as the main ingredient is insoluble in the DMF solvent, the inherent viscosity is 2.0 or more.

When the test substance is a thermoplastic polyurethane composition, the inherent viscosity of the thermoplastic polyurethane obtained by extraction as described below is measured.

N,N-Dimethylformamide (DMF) is added to the thermoplastic polyurethane composition in a proportion of 40 ml per 0.2 g of the composition and stirred at room temperature for 24 hours, following which it is separated off by filtration, thereby recovering a DMF solvent. The flow time of the recovered DMF solvent is measured using an Ubbelohde viscometer in the same way as above. Next, 5 ml of the DMF solvent is taken from the recovered DMF solvent with a 5 ml transfer pipette, placed as a sample in a precisely weighed crucible, and the DMF is removed by distillation at 120° C., leaving the thermoplastic polyurethane. The weight of the thermoplastic polyurethane ingredient is then measured and the concentration c (g/dl) of thermoplastic polyurethane ingredient present in the thermoplastic polyurethane composition is determined.

Inherent Viscosity in 0.05 mol/L n-Butylamine-Containing DMF Solution of Test Substance The test substance is dissolved in 0.05 mol/L n-butylamine-containing DMF to a concentration of 0.5 g/dl, the flow time at 30° C. of the test substance-containing solution is measured using an Ubbelohde viscometer, and the inherent viscosity ($\eta_{inh-a}$) is determined from the following formula.

$$\text{Inherent viscosity } (\eta_{inh-a}) \text{ of test substance} = [\ln(t/t_0)]/c$$

In the formula, the letter t represents the flow time (in seconds) for the 0.05 mol/L n-butylamine-containing DMF solution of the test substance, to is the flow time (s) of the solvent (0.05 mol/L n-butylamine-containing DMF), and c is the concentration (g/dl) of the test substance in the 0.05 mol/L n-butylamine-containing DMF solution.

When the test substance is a thermoplastic polyurethane composition, the inherent viscosity of the thermoplastic polyurethane obtained by extraction as described below is measured.

N,N-Dimethylformamide (DMF) containing 0.05 mol/L of n-butylamine is added to the thermoplastic polyurethane composition in a proportion of 40 ml per 0.2 g of the composition and stirred at room temperature for 24 hours, following which it is separated off by filtration, thereby recovering a 0.05 mol/L n-butylamine-containing DMF solution. The flow time of the recovered 0.05 mol/L n-butylamine-containing DMF solution is measured using an Ubbelohde viscometer in the same way as above. Next, 5 ml of the 0.05 mol/L n-butylamine-containing DMF solution is taken from the recovered DMF solution with a 5 ml transfer pipette, placed as a sample in a precisely weighed crucible, and the 0.05 mol/L n-butylamine-containing DMF is removed by distillation at 120° C., leaving the thermoplastic polyurethane. The weight of the thermoplastic polyurethane ingredient is then measured and the concentration c (g/dl) of thermoplastic polyurethane ingredient present in the thermoplastic polyurethane composition is determined.

The following is apparent from the results in Tables 4 and 5.

Comparative Example 1

The hardness difference between the center and surface of the core was small, resulting in a poor distance when the ball was hit with a driver (W#1).

Comparative Example 2

The core had a low deflection and so the ball had a high spin rate when hit with a W#1, resulting in a poor distance.

Comparative Example 3

The core had a large deflection and so the ball had a low initial velocity when hit with a W#1, resulting in a poor distance.

Comparative Example 4

The difference in hardness between the intermediate layer and the core surface was large, resulting in a poor durability to repeated impact.

Comparative Example 5

The hardness difference between the intermediate layer and the ball surface was small and so the ball had a high spin rate when hit with a W#1, resulting in a poor distance.

Comparative Example 6

The difference in hardness between the intermediate layer and the core surface was large, and the hardness difference between the intermediate layer and the ball surface was somewhat large. As a result, the ball had a poor durability to repeated impact, in addition to which it had a high spin rate when hit with a W#1, resulting in a poor distance.

Comparative Example 7

The cover layer was not composed primarily of a thermoplastic polyurethane, and so had a poor scuff resistance.

Comparative Example 8

The cover layer was thick and so the ball had a high spin rate when hit with a W#1, resulting in a poor distance.

The invention claimed is:

1. A three-piece solid golf ball comprising a solid core, an intermediate layer which encloses the core, and a cover layer which encloses and is softer than the intermediate layer, which golf ball is characterized in that the solid core undergoes a deflection of 2.8 to 3.6 mm when a load of 130 kg is applied thereto from an initial load of 10 kg and has a surface hardness and a center hardness which differ by at least 15 Shore D hardness units; the intermediate layer has a surface hardness which differs from the surface hardness of the solid core by not more than 12 Shore D hardness units; and the cover layer has a surface hardness which differs from the surface hardness of the intermediate layer by at least 7 Shore D hardness units, is made primarily of a thermoplastic polyurethane, and has a thickness in a range of 0.5 to 1.3 mm, wherein the cover layer is made of a thermoplastic polyurethane composition composed primarily of a thermoplastic polyurethane obtained by a polyurethane-forming reaction of an organic diisocyanate compound with a long-chain polyol and a chain extender, and the cover layer has an inherent viscosity in a DMF solvent of at least 1.5 dl/g and an inherent viscosity in a DMF solution containing 0.05 mol/L n-butylamine of at least 0.5 dl/g.

2. The three-piece solid golf ball of claim 1, wherein the surface hardness of the intermediate layer and the surface hardness of the cover layer differ by not more than 20 Shore D hardness units.

3. The three-piece solid golf ball of claim 1, wherein the surface hardness and the center hardness of the solid core differ by at least 18 Shore D hardness units.

4. The three-piece solid golf ball of claim 1, wherein the solid core is made of a rubber composition obtained by blending (a) a polybutadiene, (b) sulfur, (c) an unsaturated carboxylic acid and/or metal salt thereof, (d) an organosulfur compound, (e) an inorganic filler and (f) an organic peroxide.

5. The three-piece solid golf ball of claim 1, wherein the intermediate layer is made of a material that includes a compound having at least two reactive functional groups and a molecular weight of not more than 20,000 or is treated at the surface thereon with a primer.

6. The three-piece solid golf ball of claim 1, wherein the cover layer has formed on the surface thereof 250 to 350 dimples of at least five types of mutually differing diameter and/or depth, and the dimples have a surface coverage ratio (SR) of at least 79%.

7. A three-piece solid golf ball comprising a solid core, an intermediate layer which encloses the core, and a cover layer which encloses and is softer than the intermediate layer, which golf ball is characterized in that the solid core undergoes a deflection of 2.8 to 3.6 mm when a load of 130 kg is applied thereto from an initial load of 10 kg and has a surface hardness and a center hardness which differ by at least 15 Shore D hardness units; the intermediate layer has a surface hardness which differs from the surface hardness of the solid core by not more than 12 Shore D hardness units; and the cover layer has a surface hardness which differs from the surface hardness of the intermediate layer by at least 7 Shore D hardness units, is made primarily of a thermoplastic polyurethane, and has a thickness in a range of 0.5 to 1.3 mm, wherein the solid core is made of a rubber composition obtained by blending (a) a polybutadiene, (b) sulfur, (c) an unsaturated carboxylic acid and/or metal salt thereof, (d) an organosulfur compound, (e) an inorganic filler and (f) an organic peroxide.

8. The three-piece solid golf ball of claim 7, wherein the surface hardness of the intermediate layer and the surface hardness of the cover layer differ by not more than 20 Shore D hardness units.

9. The three-piece solid golf ball of claim 7, wherein the surface hardness and the center hardness of the solid core differ by at least 18 Shore D hardness units.

10. The three-piece solid golf ball of claim 7, wherein the intermediate layer is made of a material that includes a compound having at least two reactive functional groups and a molecular weight of not more than 20,000 or is treated at the surface thereon with a primer.

11. The three-piece solid golf ball of claim 7, wherein the cover layer has formed on the surface thereof 250 to 350 dimples of at least five types of mutually differing diameter and/or depth, and the dimples have a surface coverage ratio (SR) of at least 79%.

12. A three-piece solid golf ball comprising a solid core, an intermediate layer which encloses the core, and a cover layer which encloses and is softer than the intermediate layer, wherein the solid core undergoes a deflection of 2.8 to 3.6 mm when a load of 130 kg is applied thereto from an initial load of 10 kg and has a surface hardness and a center hardness which differ by at least 15 Shore D hardness units;

the intermediate layer has a surface hardness which differs from the surface hardness of the solid core by not more than 12 Shore D hardness units; and the cover layer has a surface hardness which differs from the surface hardness of the intermediate layer by at least 7 Shore D hardness units, is made primarily of a thermoplastic polyurethane, and has a thickness in a range of 0.5 to 1.3 mm, and wherein the intermediate layer is made of a material that includes a compound having at least two reactive functional groups and a molecular weight of not more than 20,000.

13. The three-piece solid golf ball of claim 12 wherein the surface hardness of the intermediate layer and the surface hardness of the cover layer differ by not more than 20 Shore D hardness units.

14. The three-piece solid golf ball of claim 12 wherein the surface hardness and the center hardness of the solid core differ by at least 18 Shore D hardness units.

15. The three-piece solid golf ball of claim 12 wherein the cover layer has formed on the surface thereof 250 to 350 dimples of at least five types of mutually differing diameter and/or depth, and the dimples have a surface coverage ratio (SR) of at least 790%.

* * * * *